US007672627B2

(12) United States Patent
Suzuki et al.

(10) Patent No.: US 7,672,627 B2
(45) Date of Patent: Mar. 2, 2010

(54) IMAGE FORMING APPARATUS

(75) Inventors: Shiroh Suzuki, Ebina (JP); Tetsuo Ishizuka, Ebina (JP); Fumio Furusawa, Ebina (JP); Osamu Uto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 141 days.

(21) Appl. No.: 12/052,770

(22) Filed: Mar. 21, 2008

(65) Prior Publication Data

US 2009/0080947 A1 Mar. 26, 2009

(30) Foreign Application Priority Data

Sep. 21, 2007 (JP) ..... 2007-245193

(51) Int. Cl.
*G03G 15/01* (2006.01)
*G03G 15/00* (2006.01)
*G03G 21/12* (2006.01)

(52) U.S. Cl. ..... 399/302; 399/88; 399/110; 399/360

(58) Field of Classification Search ..... 399/88, 399/360, 302, 308, 101, 110
See application file for complete search history.

(56) References Cited

U.S. PATENT DOCUMENTS 5,079,597 A * 1/1992 Mauer et al. ..... 399/302
6,826,377 B2 * 11/2004 Kitozaki ..... 399/88
6,985,681 B2 * 1/2006 Taguchi et al. ..... 399/302
7,020,415 B2 * 3/2006 Abe ..... 399/110
7,020,432 B2 * 3/2006 Omata et al. ..... 399/308
7,218,883 B2 * 5/2007 Aruga et al. ..... 399/302
7,373,092 B2 5/2008 Tawada
7,406,283 B2 * 7/2008 Noguchi et al. ..... 399/302
2005/0220515 A1 * 10/2005 Wakana ..... 399/360
2006/0008288 A1 * 1/2006 Kuma et al.
2007/0278735 A1 * 12/2007 Sudo et al.

FOREIGN PATENT DOCUMENTS

JP 2003-173051 A 6/2003
JP 2004-102137 A 4/2004
JP 2005-37621 A 2/2005
JP 2006-31054 A 2/2006
JP 2006-85112 A 3/2006

OTHER PUBLICATIONS

Japanese Office Action dated Aug. 11, 2009.

* cited by examiner

*Primary Examiner*—Susan S Lee
(74) *Attorney, Agent, or Firm*—Sughrue Mion, PLLC

(57) ABSTRACT

An image forming apparatus includes: an intermediate transfer body; a plurality of image forming portions; a secondary transfer unit; a recording medium accommodating container; a waste toner accommodating container; a first electrical part; and a second electrical part.

4 Claims, 6 Drawing Sheets

IMAGE FORMING APPARATUS

CROSS-REFERENCE TO RELATED APPLICATIONS

This application is based on and claims priority under 35 U.S.C. 119 from Japanese Patent Application No. 2007-245193 filed Sep. 21, 2007.

BACKGROUND

Technical Field

The present invention relates to an image forming apparatus.

SUMMARY

According to an aspect of the present invention, an image forming apparatus includes: an intermediate transfer body that is a belt-shaped member stretched among plural rolls, and that is arranged in an inclined state to a horizontal direction so that a lower traveling course of the belt-shaped member becomes lower toward the downstream side along the traveling direction thereof and becomes higher toward the upstream side thereof; a plurality of image forming portions that are arranged below the intermediate transfer body, and that are arranged in parallel so as to primarily transfer toner images of different colors formed on image carriers onto the lower traveling course of the intermediate transfer body; a secondary transfer unit that is arranged at an end portion on the lower side of the intermediate transfer body arranged in the inclined state to the horizontal direction, and that secondarily transfers, on a recording medium, the toner images primarily transferred onto the intermediate transfer body; a recording medium accommodating container that is arranged below the plural image forming portions in a state of accommodating the recording medium therein, and that feeds the recording medium to the second transfer unit from the downside in the vertical direction toward the upside; a waste toner accommodating container that is arranged so that at least a part thereof is located below the image forming portion located at the end portion of the belt-shaped intermediate transfer body on the side opposite to the side where the secondary transfer unit is arranged, and that accommodates waste toner removed from the image carrier of each image forming portion and waste toner removed from the intermediate transfer body; a first electrical part that is arranged in space above the waste toner accommodating container; and a second electrical part that is arranged in space having a triangular section formed by an upper surface of the recording medium accommodating container, lower surfaces of the plural image forming portions, and a side surface of the waste toner accommodating container.

BRIEF DESCRIPTION OF THE DRAWINGS

Exemplary embodiment of the present invention will be described in detail based on the following figures, wherein.

DETAILED DESCRIPTION

Embodiment of this invention will be described below with reference to drawings.

First Embodiment

Figure 2:
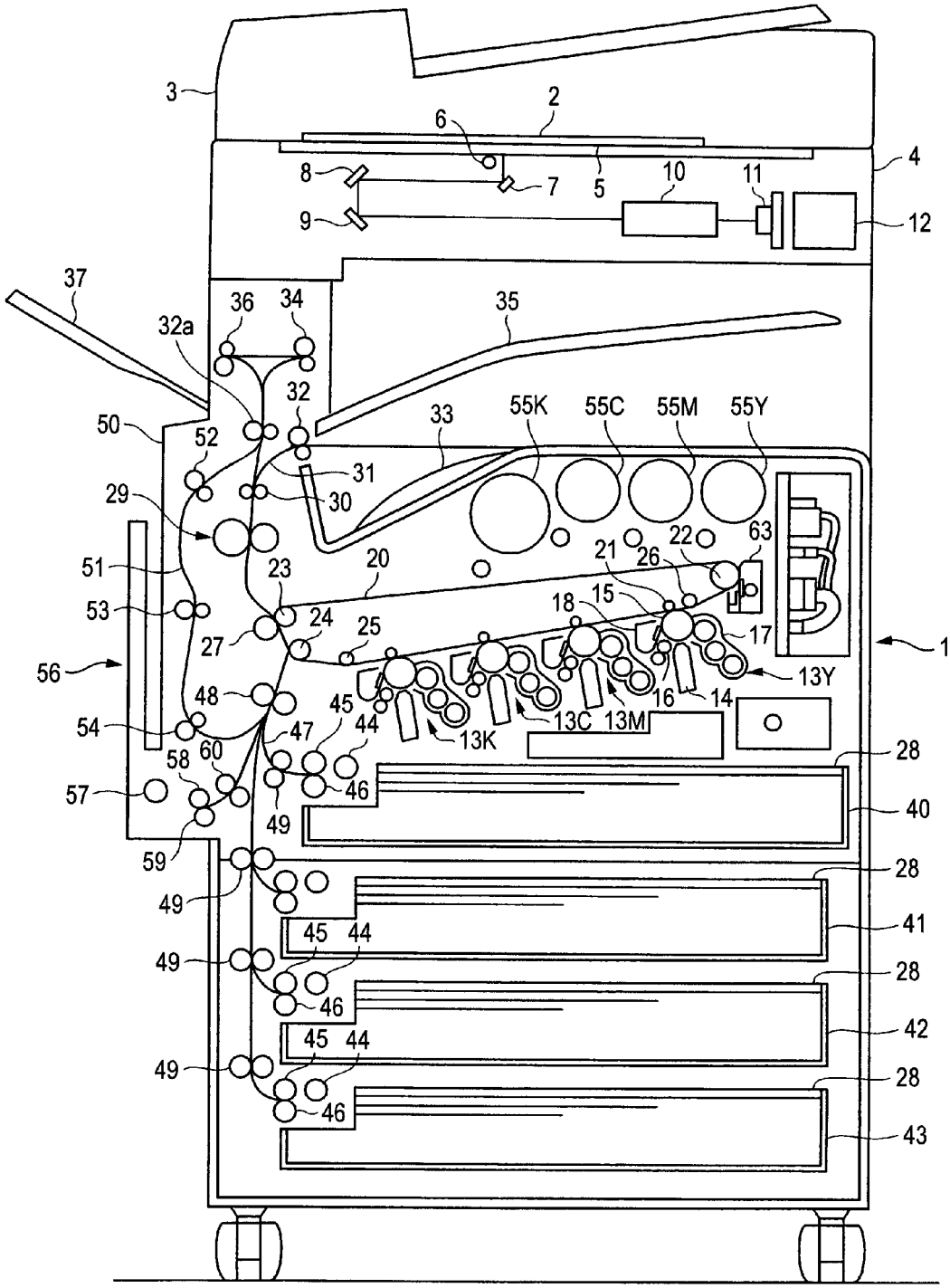
FIG. 2 is a constitutional diagram showing the tandem type full-color multifunctional machine as the image forming apparatus according to the first embodiment of this invention.

FIG. 2 shows a tandem type digital color multifunctional machine as an image forming apparatus according to a first embodiment of the invention. Though this tandem type digital color multifunctional machine includes an image reading device, it may constituted as a printer or the like including no imaging reading device.

In FIG. 2, numeral 1 shows a main body of the tandem type digital color multifunctional machine. At the upper portion of this multifunctional machine body 1, there are provided an automatic document feeder 3 which feeds automatically original documents 2 one by one in a separate state, and a document reader 4 which reads an image of the original document 2 fed by the automatic document feeder 3. This document reader 4 illuminates the original document 2 placed on a platen glass 5 by means of a light source 6, and scans and exposes an image of light reflected from the original document 2 on an image reading element 11 composed of a CCD or like through a reduction optical system including a full rate mirror 7, half rate mirrors 8, 9, and an imaging lens 10, thereby to read the image of light reflected on the original document 2 in a predetermined dot density (for example, 16 dots/mm) by means of this image reading element 11.

The image of light reflected on the original document 2 read by the document reader 4 is sent to an image processing device 12 as original reflectivity data in three colors i.e., read (R), green (G) and blue (B) (each having eight bits), and the image processing device 12 performs predetermined image processing such as correction of shading, correction of misalignment, conversion of the brightness and color space, gamma correction, frame elimination, edition of colors and movement, and the like on the reflectivity data of the original document 2. Further, the image processing device 12 performs predetermined image processing also on image data sent from a not-shown personal computer or the like.

The image data which have been subjected to the predetermined image processing at the image processing device 12 as described above are converted into tone data of four colors, i.e., yellow (Y), magenta (M), cyan (C) and black (K) (each having eight bits) by the image processing device 12, and are sent to image exposure devices 14 of image forming units 13Y, 13M, 13C and 13K of respective colors, yellow (Y), magenta (M), cyan (C) and black (K). This image exposure device 14 performs image exposure with light emitted from a LED array according to the tone data of the predetermined color of the original document 2.

In this embodiment, the image forming apparatus is constituted so as to include: a intermediate transfer body, which is a belt-shaped member stretched among plural rolls, and is arranged in an inclined state to a horizontal direction so that a lower traveling course of its belt-shaped member becomes lower toward the downstream side along the traveling direction thereof and becomes higher toward the upstream side thereof;

plural image forming portions, which are arranged below the intermediate transfer body, and arranged in parallel so as to primarily transfer toner images of different colors formed on image carriers onto the lower traveling course of the intermediate transfer body;

a secondary transfer unit, which is arranged at an end portion on the lower side of the intermediate transfer body arranged in the inclined state to the horizontal direction, and secondarily transfers, on a recording medium, the toner images primarily transferred onto the intermediate transfer body;

a recording medium accommodating container, which is arranged below the plural image forming portions in a state where it accommodates the recording medium therein, and feeds the recording medium to the second transfer unit from the downside in the vertical direction toward the upside; a waste toner accommodating container, which is arranged so that at least a part thereof is located below the image forming portion located at the other end portion of the intermediate transfer body on the opposite side to the side where the secondary transfer unit is arranged, and accommodates water toner removed from the image carrier of each image forming portion and waste toner removed from the intermediate transfer body;

a low-voltage power supply arranged in space above the waste toner accommodating container; and a high-voltage power supply which is arranged in space having a triangular section formed by an upper surface of the recording medium accommodating container, lower surfaces of the plural image forming portions, and a side surface of the waste toner accommodating container, and supplies high voltage to the plural image forming portions.

Inside the tandem type digital color multifunctional machine body 1, as shown in FIG. 2, four image forming units (image forming portions) 13Y, 13M, 13C and 13K for yellow (Y), magenta (M), cyan (C) and black (K) are arranged in parallel at constant intervals in a state where they are inclined obliquely at a predetermined angle to the horizontal direction so that the image forming unit 13Y for the first color, yellow (Y) is located in the high position and the imaging forming unit 13K for the last color, black (K) is located in the low position.

Thus, by arranging the four image forming units 13Y, 13M, 13C and 13K for yellow (Y), magenta (M), cyan (C) and black (K) are arranged in the state where they are inclined obliquely at the predetermined angle, compared with the case where these four image forming units 13Y, 13M, 13C and 13K are arranged horizontally, the distance between them in the width direction can be set short, so that the width of the apparatus body 1 can be reduced thereby to enable miniaturization of the apparatus.

Figure 3:
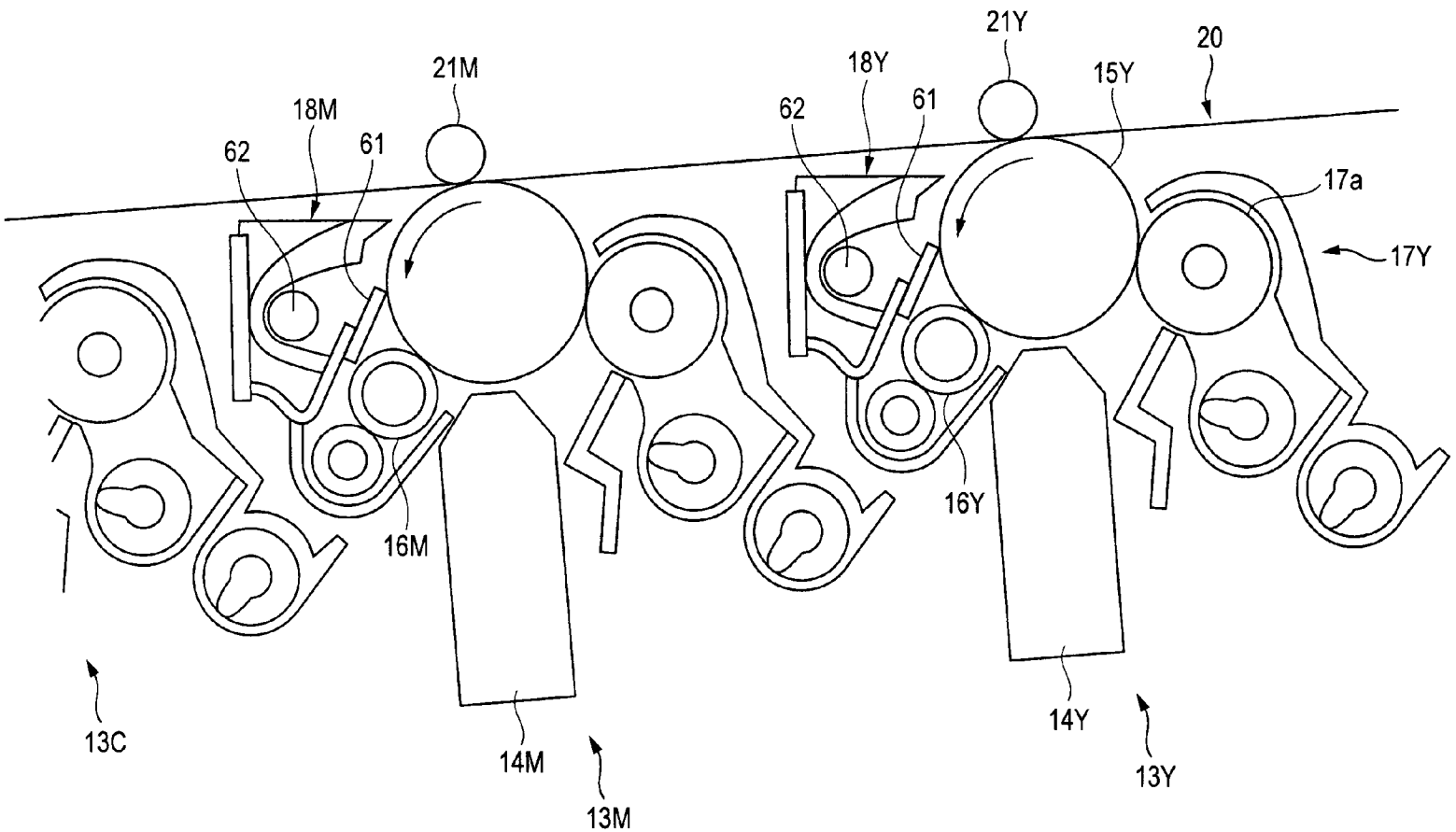
FIG. 3 is a constitutional diagram showing an image forming portion of the tandem type full-color multifunctional machine as the image forming apparatus according to the first embodiment of this invention.

These four image forming units 13Y, 13M, 13C and 13K have basically the same configuration. As shown in FIGS. 2 and 3, each image forming unit is generally constituted by a photosensitive drum 15 as an image carrier which is driven for rotation at a predetermined speed by a not-shown drive unit, a charging roll 16 for primary charge which charges uniformly a surface of this photosensitive drum 15, an image exposure device 14 for exposing an image associated with a predetermined color on the surface of the photosensitive drum 15 to form an electrostatic latent image, which is constituted by a print head using LED, a developing device 17 for developing the electrostatic latent image formed on the photosensitive drum 15 with a toner in the predetermined color, and a cleaning device 18 for cleaning the surface of the photosensitive drum 15.

The above photosensitive drum 15 is formed in the shape of a drum having, for example, a diameter of 30 mm, and uses an organic photoconductor having an overcoat layer on its surface. The photosensitive drum 15 is driven for rotation by a not-shown drive motor at a predetermined speed.

Further, as the charging roll 16, for example, a roll-shaped charger is used, in which a surface of a core bar is coated with a conductive layer formed of a synthetic resin or rubber and having the adjusted electric resistance. As the core bar of this charging roll 16, that to which a predetermined charge bias is applied is used. Further, on the surface of the charging roll 16, a cleaning roll 16*a* for removing foreign matters such as toner attached onto the surface of the charging roll 16 is arranged so as to come into contact with the charging roll 16.

The image exposure device 14, as shown in FIG. 2, is individually arranged in each of the four image forming units 13Y, 13M, 13C and 13K. As the image exposure device 14 provided for each of the image forming units 13Y, 13M, 13C and 13K, there is used a device having a LED (light emitting diode) array in which LED elements are arranged linearly at a predetermined pitch (for example, 600 dpi), and a selfoc lens (commodity name) array which forms an image by light emitted from each LED element of the LED array in the shape of a spot. Further, the image exposure device 14 is, as shown in FIG. 2, constructed so as to scan and expose the image on the photosensitive drum 15 from the downside.

The image processing device 12 sequentially outputs image data of the respective colors to the image exposure devices 14Y, 14M, 14C and 14K individually provided for the respective image forming units 13Y, 13M, 13C and 13K for yellow (Y), magenta (M), cyan (C) and black (K). Laser beams emitted from these image exposure devices 14Y, 14M, 14C and 14K according to the image data are scanned to expose the surfaces of the respective corresponding photosensitive drums 15, thereby forming electrostatic latent images. The electrostatic latent images formed on the above photosensitive drums 15 are developed into toner images in yellow (Y), magenta (M), cyan (C) and black (K) by the respective developing devices 17Y, 17M, 17C and 17K.

Toner images in yellow (Y), magenta (M), cyan (C) and black (K) sequentially formed on the photosensitive drums 15 of the image forming units 13Y, 13M, 13C and 13K are transferred in a multilayer manner by primary transfer rolls 21 onto an intermediate transfer belt 20 as a intermediate transfer body which is arranged above the image forming units 13Y, 13M, 13C and 13K in an inclined state.

This intermediate transfer belt 20 is a belt-shaped member stretched among plural rolls, and is arranged in the inclined state to a horizontal direction so that a lower traveling course of its belt-shaped member becomes lower toward the downstream side along the traveling direction thereof and becomes higher toward the upstream side thereof.

Figure 1:
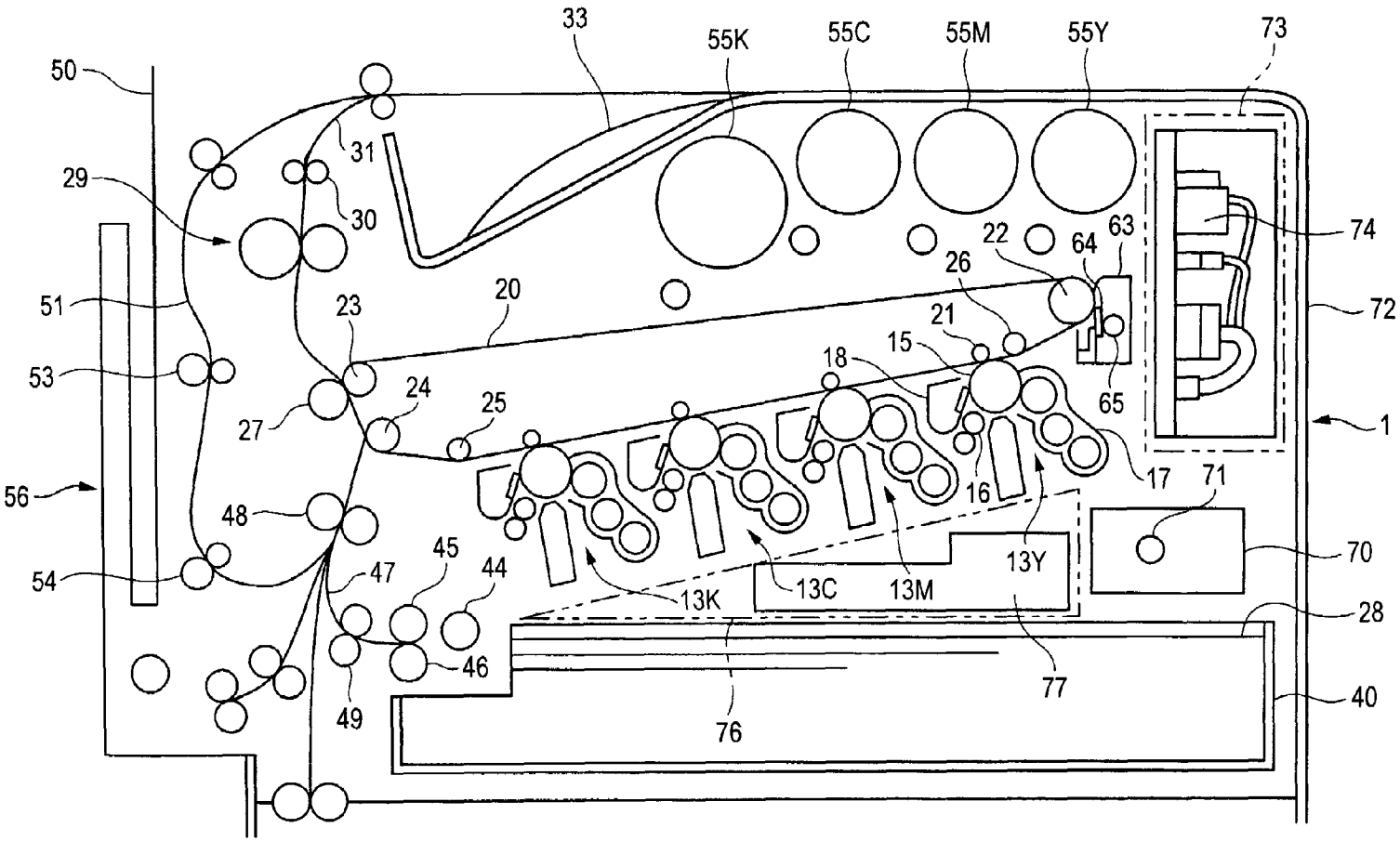
FIG. 1 is an enlarged constitutional diagram showing a main portion of a tandem type full-color multifunctional machine as an image forming apparatus according to a first embodiment of this invention.

Namely, the intermediate transfer belt 20, as shown in FIG. 1, is stretched at a constant tension among a drive roll 22, a backup roll 23, a tension roll 24, a first idle roll 25, and a second idle roll, and is driven for circulation at a predetermined speed in the direction indicated by the arrow by the drive roll 22 which is driven for rotation by a dedicated driving motor (not shown) having excellent constant speed properties. As the intermediate transfer belt 20, for example, a member is used which is formed like an endless belt by forming a synthetic resin film having flexibility such as PET (polyethylene terephthalate) in a belt-like configuration and by connecting both ends of the synthetic resin film formed in the belt-like configuration by means of welding or the like. The intermediate transfer 20 is arranged so as to come into contact with the photosensitive drums 15Y, 15M, 15C and 15K of the respective image forming units 13Y, 13M 13C and 13K in the lower traveling course thereof.

Figure 4:
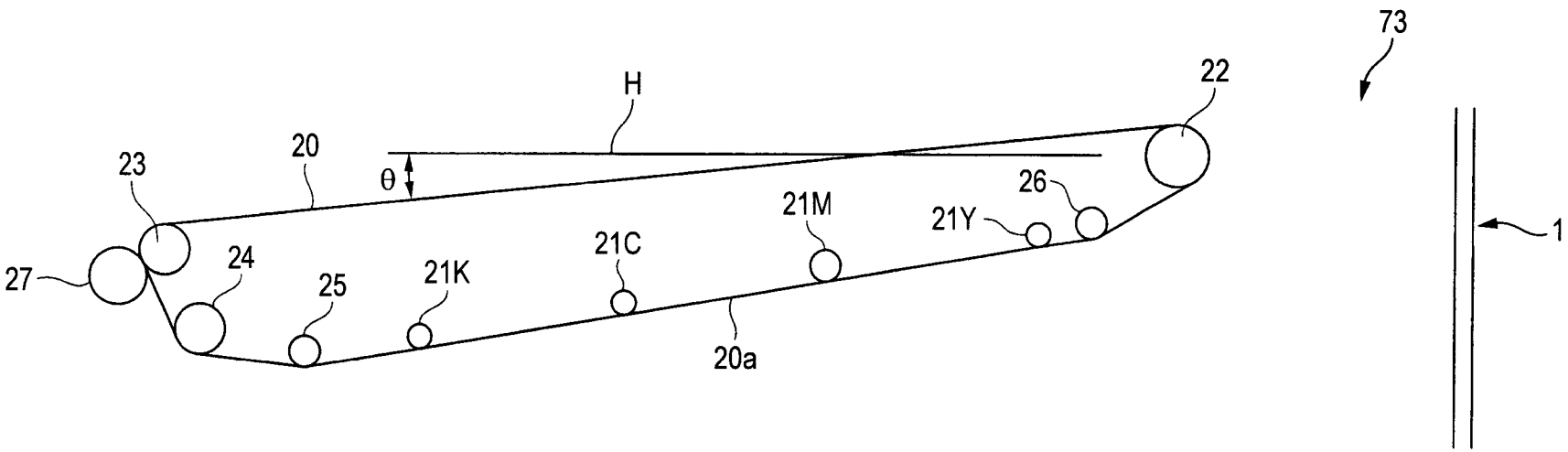
FIG. 4 is a constitutional diagram showing arrangement of an intermediate transfer belt.

Further, on the intermediate transfer belt 20, as shown in FIGS. 1 and 4, a secondary transfer roll 27 as a secondary transfer unit which is arranged at an end portion on the lower side of the intermediate transfer belt 20 arranged in an inclined state at an angle θ to the horizontal direction, and transfers secondarily on a recording medium the toner images subjected to the primary transfer on the intermediate transfer belt 20 is arranged so as to come into contact with the surface of the stretched intermediate transfer belt 20 by the backup roll 23.

The toner images in yellow (Y), magenta (M), cyan (C) and black (K) transferred onto the intermediate transfer belt 20 in the multilayer manner are subjected to secondary transfer onto recording paper 28 as the recording medium by the secondary transfer roll 27 which comes into pressure contact with the backup roll 23, using a pressure or an electrostatic force, and the recording paper 28 having the toner images in the respective colors transferred thereon is transported to a fixing device 29 located up. The secondary transfer roll 27 comes into pressure contact with the side portion of the backup roll 23, and transfers secondarily the toner images in the respective colors onto the recording paper 28 transported from the downside in the vertical direction to the upside. Then, the recording paper 28 on which the toner images in the respective colors have been transferred is subjected to heat-pressure fixing processing by a fixing device 29. Thereafter, the recording paper 28 is discharged by a first discharge roll 32 through an exit roll 30 of the fixing device 29 and a paper discharge path 31 onto a first discharge tray 33 provided at the upper portion of the apparatus body 1, discharged by a second discharge roll 34 onto a second discharge tray 35 provided at the upper portion of the apparatus body 1, or discharged by a third discharge roll 36 onto a third face-up tray 37 provided at the side portion of the apparatus body 1.

The recording paper 28 in a predetermined size, as shown in FIG. 2, is transported by a paper feed roller 44 and a pair of rollers 45, 46 for paper separation and transportation from a paper feed tray 40 as a recording medium accommodating container arranged inside the multifunctional machine body 1 or paper feed trays 41 to 43 disposed at the lower portion of the multifunctional machine body 1 through a paper transport roll 49 and a paper transporting path 47 to a registration roll 48, and is temporarily stopped there. The recording paper 28 supplied from any of the paper feed trays 40 to 43 is fed to a position for secondary transfer of the intermediate transfer belt 20 by the registration roll 48 which rotates at predetermined timing.

In case that double-side copy of a full-color is to be made in the above digital color printer and copying machine, the recording paper 28 having an image recorded on one side thereof is transported to the second discharge roll 34 by a transport roll 32*a*, the transporting direction is switched by a not-shown switch gate while the rear end of the recording paper 28 is nipped by the second discharge roll 34, and the recording paper 28 is transported to a transport unit 50 for both sides. In this transport unit 50 for both sides, by transport roller pairs 52 to 54 provided along a paper transport path 51, the recording paper 28 is transported again to the registration roll 48 in a state where the side of the recording paper 28 is inverted. Then, an image is transferred and fixed on the other side of the recording paper 28, and thereafter discharged onto the first discharge tray 33 to the third discharge tray 37.

In FIG. 2, characters 55Y, 55M, 55C and 55K show respectively a toner cartridge which supply toner of a predetermined color to the developing device 17 for each color of yellow (Y), magenta (M), cyan (C) and black (K). Since the toner cartridge which accommodates toner of black (K) therein is high in frequency of use, it is formed into a large-sized cartridge, compared with the toner cartridge of other colors.

Further, in FIG. 2, numeral 56 shows a manual paper feed tray. From this manual paper feed tray 56, a recording medium 28 having a desired material and a predetermined size is transported to the registration roll 48 through a transport roll 60 by a paper feed roller 57 and a pair of rollers 58, 59 for paper separation and transportation.

FIG. 3 shows each image forming unit of the above digital color printer and copying machine.

All of the four image forming units 13Y, 13M, 13C and 13K for yellow, magenta, cyan and black, as shown in FIG. 3, have the same configuration, and are so constructed that toner images in yellow, magenta, cyan and black are sequentially formed at predetermined timing, as described above. The image forming units 13Y, 13M, 13C and 13K for the respective colors, as described above, have the respective photosensitive drums 15, and surfaces of these photosensitive drums 15 are uniformly charged by the charge roll 16 for primary charge. Thereafter, laser beams emitted from the image exposure devices 14 according to the image data are scanned to expose the surfaces of the above photosensitive drums 15, thereby forming electrostatic latent images corresponding to the respective colors. The laser beam to be scanned to expose the surface of the photosensitive drum 15 is so set as to expose it at a predetermined inclined angle from the oblique downside which is a little to the right of a portion just under the photosensitive drum 15. The electrostatic latent images formed on the above photosensitive drums 15 are developed with toner in yellow, magenta, cyan and black by development rolls 17*a* of the developing devices 17 in the respective image forming units 13Y, 13M, 13C and 13K, thereby to become visible toner images. These visible toner images are sequentially transferred in a multilayer manner onto the intermediate transfer belt 20 by charging of the primary transfer roll 21.

Each of the above developing devices 17Y, 17M, 17C and 17K adopts a two-component development system using two-component developer containing toner and carrier, in which a magnetic brush of the two-component developer containing the toner and the carrier is formed on the surface of the development roll 17*a* thereby to develop the electrostatic latent image formed on the surface of the photoconductive drum 15Y, 15M, 15C or 15K for the corresponding color.

After completion of the toner image transfer step, residual toner and paper dust are removed from the surface of the photosensitive drum 15 by the cleaning device 18 thereby to prepare for the next image forming process. The cleaning device 18 has a cleaning blade 61 by which the waste toner and paper dust on the photosensitive drum 15 are removed. The waste toner and the like removed by the above cleaning blade 61 are transported, by a transport auger 62 provided in the cleaning device 18, to a front side of the copying machine body 1 at predetermined timing, and are collected through a not-shown transport pipe to a waste toner collection container which will be described later.

After completion of the toner image transfer step, as shown in FIG. 2, the residual toner and paper dust are removed from the surface of the intermediate transfer belt 20 by a cleaning device 63 thereby to prepare for the next image forming process. The cleaning device 63 has, as shown in FIG. 1, a cleaning blade 64 by which the waste toner and paper dust on the intermediate transfer belt 25 are removed. The waste toner and the like removed by the above cleaning blade 64 are transported, by a transport auger 65 provided in the cleaning device 63, to the front side of the copying machine body 1 at predetermined timing, and are collected through the not-shown transport pipe to the waste toner collection container which will be described later.

In this embodiment, there are provided: a waste toner accommodating container, which is arranged so that at least a part thereof is located below the image forming portion located at an end portion of the intermediate transfer body on the opposite side to the side where the secondary transfer unit is arranged, and accommodates therein water toner removed from the image carrier of each image forming portion and waste toner removed from the intermediate transfer body;

a low-voltage power supply which is arranged in space above the waste toner accommodating container; and a high-voltage power supply which is arranged in space having a triangular section formed by an upper surface of the recording medium accommodating container, lower surfaces of the plural image forming portions, and a side surface of the waste toner accommodating container, and supplies high voltage to the plural image forming portions.

Namely, in this embodiment, there is provided a waste toner bottle 70 as the waste toner accommodating container, which is arranged, as shown in FIG. 1, so that at least a part thereof is located below the image forming unit 13Y for yellow located at the end portion of the intermediate transfer belt 20 on the opposite side to the side where the secondary transfer roll 27 is arranged, and accommodates therein the water toner removed from the photosensitive drums of the respective image forming units 13Y, 13M, 13C and 13K for yellow (Y), magenta (M), cyan (C) and black (K), and the waste toner removed from the intermediate transfer belt 20.

Figure 5:
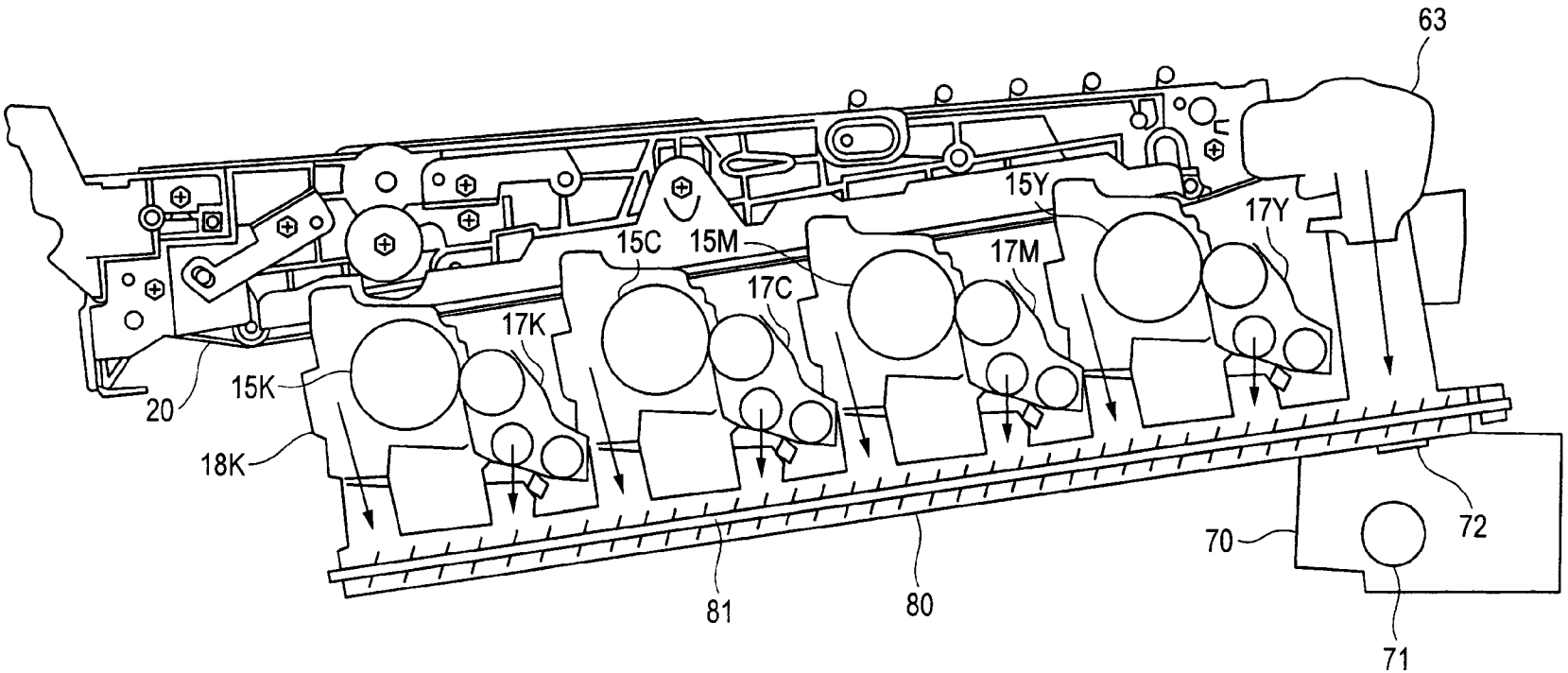
FIG. 5 is a constitutional diagram showing a waste toner collecting path.

This waste toner bottle 70, as shown in FIG. 1, is formed in the shape of a box having a rectangular section. The waste toner bottle 70 has an elongate shape arranged along the depth direction (vertical direction to the drawing) of the multifunctional machine body 1, and is so constructed as to have small installation space and large capacity. The waste toner removed by the cleaning device 18 from the photosensitive drums 15 of the respective image forming units 13Y, 13M, 13C and 13K, and the waste toner removed by the cleaning device 63 from the intermediate transfer belt 20 are collected, as shown in FIG. 5, through a transport pipe 80 having an auger 81 therein from a collection port 72 provided on the upper surface on the front side of the waste toner bottle 70 to the inside of the waste toner bottle 70. The collected waste toners are transported, by a transport auger 71 provided along the depth direction of the waste toner bottle 70, to the interior. Further, in the shown embodiment, the used developer which has been collected from the developing device 17 is also collected into the waste toner bottle 70 through the transport pipe 80.

Figure 6:
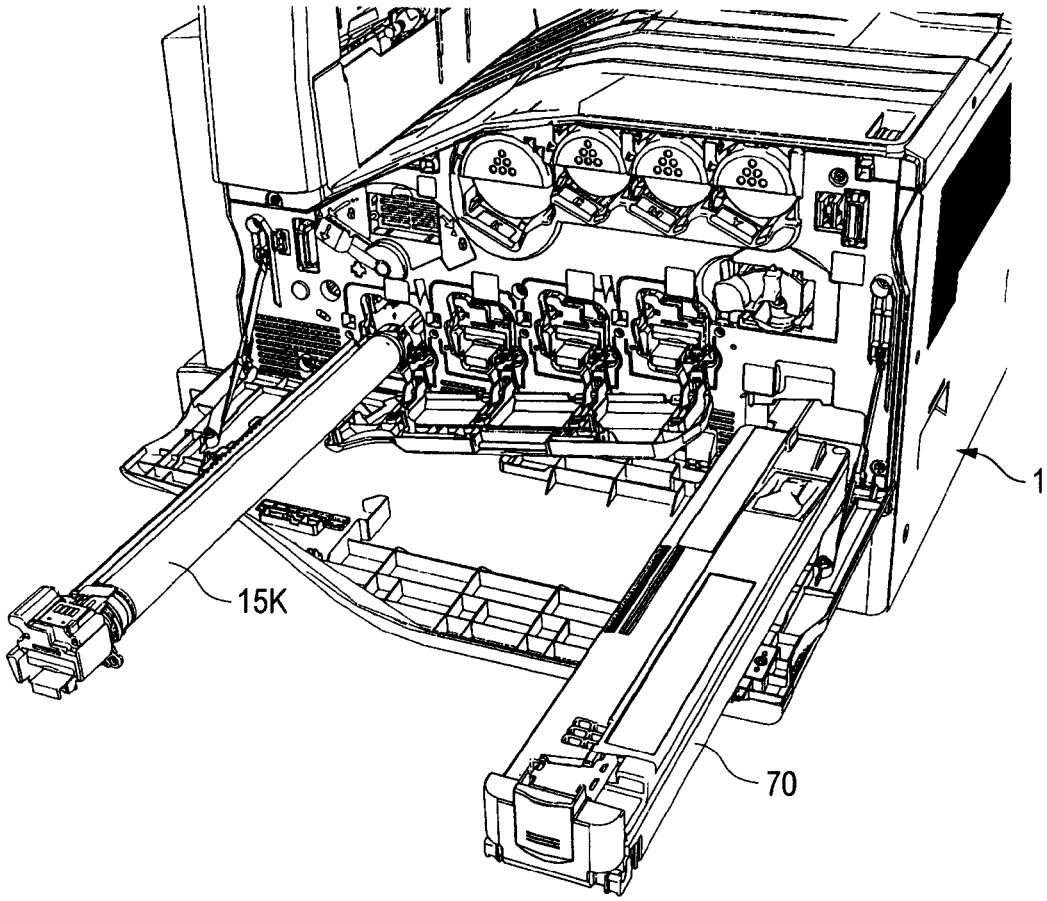
FIG. 6 is a perspective constitutional diagram showing a state where a waste toner bottle is pulled out.

Further, the above waste toner bottle 70, as shown in FIGS. 1 and 6, is freely pulled out to the front side of the multifunctional machine body 1. In case that the waste toner bottle 70 is in a full condition, a front cover C of the multifunctional machine body 1 is opened to expose the waste toner bottle 70, and the waste toner bottle 70 is slid and pulled out to the front side, whereby the waste toner bottle 70 can be detached from the multifunctional machine body 1 and can be readily replaced by a new waste toner bottle 70.

The waste toner bottle 70, as shown in FIG. 1, is so arranged that its part is located below the image forming unit 13Y for the first color, i.e., yellow. Since the position where the image forming unit 13Y for yellow is arranged is set higher than the position where the image forming unit 13M for magenta adjacent to the image forming unit 13Y is arranged, even in case that a part of the waste toner bottle 70 is located below the image forming unit 13Y for yellow, the waste toner bottle 70 does not interfere with the mage forming unit 13Y for yellow. Therefore, the space below the image forming unit 13Y for yellow arranged in the highest position can be effectively utilized.

Below the respective image forming units 13Y, 13M, 13C and 13K for yellow (Y), magenta (M), cyan (C) and black (K), as shown in FIG. 1, a uppermost stage paper feed tray 40 of paper feed trays is arranged. As the paper feed tray 40, for example, a tray which can accommodate therein recording paper 28 of A3-size that is the largest size is used. The recording paper 28 fed from this paper feed tray 40 is transported by the paper feed roller 44 and a pair of rollers 45, 46 for paper separation and transportation through a paper transport roll 49 and a paper transporting path 47 to the registration roll 48, and then transported to the position for secondary transfer of the intermediate transfer belt 20 by the registration roll 48.

The intermediate transfer belt 20, as shown in FIG. 1, is arranged in the state where it is obliquely inclined for the purpose of size-reduction of the apparatus, and the distance at which the belt 20 is stretched between the drive roll 22 and the backup roll 23 is set as short as possible. Further, the respective image forming units 13Y, 13M, 13C and 13K for yellow (Y), magenta (M), cyan (C) and black (K) are arranged along the lower traveling course of the intermediate transfer belt 20, and the image forming unit 13Y for yellow located at the end portion is arranged in a position substantially equal to a position of the drive roll 2 of the intermediate transfer belt 20.

On the other hand, the uppermost stage paper feed tray 40 for accommodating the recording paper 28 of A3-size that is the largest size is arranged so that its one end (the right end in the figure) comes close to an outer wall 72 of the multifunctional machine body 1, and the installation width of the intermediate transfer belt 20 is smaller than the length of the uppermost paper feed tray 40. Therefore, as shown in FIG. 1, above the waste toner bottle 70 arranged so that its part is located below the image forming unit 13Y for yellow a first space 73 exists between the cleaning device 63 and the outer wall 72 of the multifunctional machine body 1.

In this first space 73, there is arranged a low-voltage power supply 74 for supplying low voltage of 24V or less to a drive motor or the image exposure device 14 of the multifunctional machine, a power unit including an AC power supply, or a controller for controlling print.

The respective image forming units 13Y, 13M, 13C and 13K for yellow (Y), magenta (M), cyan (C) and black (K) are arranged in the obliquely inclined state, with the result that a second pace 76 having a triangular section is formed among the lower surfaces of these respective image forming units 13Y, 13M, 13C and 13K, the upper surface of the uppermost paper feed tray 40, and the side surface of the waste toner bottle 70, as shown in FIG. 1. In this second space 76, a high-voltage power supply 77 is arranged, which applies various bias voltages including DC high-voltage and AC high-voltage to the charging rolls 16 of the respective image forming units 13Y, 13M, 13C and 13K for yellow (Y), magenta (M), cyan (C) and black (K), the development rolls 17*a* of the developing devices 17, or the primary transfer rolls 21. Since this high-voltage power supply 77 is arranged close to the downsides of the image forming units 13Y, 13M, 13C and 13K, it is possible to shorten a power supply line such as harness through which the DC and AC high-voltages are applied, to reduce load resistance of the power supply line, and to restrain electromagnetic waves from leaking to the outside. Under the above structure, in the multifunctional machine according to this embodiment, even in case that size-reduction of the apparatus is achieved and operational ease is improved by the following manner, the number of stages and capacity of the paper feed tray can be secured without making a position of the image reading device high and worsening the operational ease.

Namely, in the above tandem type digital color multifunctional machine, since the intermediate transfer belt 20 is arranged, as shown in FIG. 1, in the state where it is inclined obliquely to the horizontal direction, compared with the case where the same intermediate transfer belt 20 is arranged horizontally, the installation width of the intermediate transfer belt 20 can be set small, so that miniaturization of the apparatus can be realized.

Further, in the above tandem type digital color multifunctional machine, since the intermediate transfer belt 20 is arranged in the obliquely inclined state, resultantly, the image forming units 13Y, 13M, 13C and 13K to be arranged in the lower traveling course of the intermediate transfer belt 20 are also arranged in the obliquely inclined state. Therefore, even in case that the uppermost paper feed tray 40 is arranged near the lower sides of the image forming units 13Y, 13M, 13C and 13K, the second space having the triangular section is formed between the lower surfaces of the image forming units 13Y, 13M, 13C and 13K and the upper surface of the uppermost paper feed tray 40.

Further, in case that the uppermost paper feed tray 40 can accommodate therein the recording paper 28 of A3-size that is the largest size, the installation width of the paper feed tray 40 becomes longer than the installation width of the intermediate transfer belt 20. Further, in case that the recording paper 28 fed from the paper feed tray 40 can be immediately supplied to the secondary transfer position of the intermediate transfer belt 20, and also in case that the end of the paper feed tray 40 is arranged close to the outer wall of the multifunctional machine body 1 to realize the size reduction of the apparatus, the first space exists on the outer wall side of the multifunctional machine body 1 of the intermediate transfer belt 20 because the installation width of the intermediate transfer belt 20 is shorter than that of the paper feed tray 40.

Therefore, the low-voltage power supply 74 is installed in the above first space, the waste toner bottle 70 is installed below the low-voltage power supply 74, and the high-voltage power supply 77 is installed in the second space having the triangular section formed among the lower surfaces of the respective image forming units 13Y, 13M, 13C and 13K, the upper surface of the uppermost paper feed tray 40, and the side surface of the waste toner bottle 70, whereby of the components of the multifunctional machine, apparatus constituting members other than the image forming member, of which positions are to be fixed for the reason on their functions, can be arranged in the first and second spaces 73, 76 produced necessarily.

Therefore, it is prevented that: the waste toner bottle 70 interferes with the paper feed tray, like the case where the waste toner bottle 70 is arranged on the front side of the multifunctional machine body 1; or the height of the multifunctional machine body 1 increases in order to avoid the interference between the waste toner bottle 70 and the paper feed tray, thereby to cause the image reading device 5 to be located in a high position and to lower operational ease.

Further, the waste toner bottle 70, as shown in FIG. 6, is arranged so as to be freely pulled out to the front side of the multifunctional machine body 1, whereby the operational ease improves and the volume of the waste toner bottle 70 can be secured. Further, in this connection, the photosensitive drum 15 is also arranged, as shown in FIG. 6, so as to be freely pulled out to the front side of the multifunctional machine body 1.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an intermediate transfer body that is a belt-shaped member stretched among plural rolls, and that is arranged in an inclined state to a horizontal direction so that a lower traveling course of the belt-shaped member becomes lower toward the downstream side along the traveling direction thereof and becomes higher toward the upstream side thereof;

a plurality of image forming portions that are arranged below the intermediate transfer body, and that are arranged in parallel so as to primarily transfer toner images of different colors formed on image carriers onto the lower traveling course of the intermediate transfer body;

a secondary transfer unit that is arranged at an end portion on the lower side of the intermediate transfer body arranged in the inclined state to the horizontal direction, and that secondarily transfers, on a recording medium, the toner images primarily transferred onto the intermediate transfer body;

a recording medium accommodating container that is arranged below the plural image forming portions in a state of accommodating the recording medium therein, and that feeds the recording medium to the second transfer unit from the downside in the vertical direction toward the upside;

a waste toner accommodating container that is arranged so that at least a part thereof is located below the image forming portion located at the end portion of the intermediate transfer body on the side opposite to the side where the secondary transfer unit is arranged, and that accommodates waste toner removed from the image carrier of each image forming portion and waste toner removed from the intermediate transfer body;

a first electrical part that is arranged in space above the waste toner accommodating container; and a second electrical part that is arranged in space having a triangular section formed by an upper surface of the recording medium accommodating container, lower surfaces of the plural image forming portions, and a side surface of the waste toner accommodating container.

2. The image forming apparatus as claimed in claim 1, wherein each of the plurality of image forming portions comprise;

an exposure unit that includes an LED array, and that performs an exposure; and an image carrier that includes a photosensitive drum on which an image is formed by the image exposure of the exposure unit.

3. The image forming apparatus as claimed in claim 1, wherein the width of the recording medium accommodating container is longer than the width of the intermediate transfer body, and the recording medium fed from the recording medium accommodating container can be immediately supplied to the secondary transfer position of the intermediate transfer body.

4. The image forming apparatus as claimed in claim 1, wherein the image carrier and the waste toner accommodating container are attached so that they can be pulled out to a front side of an image forming apparatus body.

* * * * *